United States Patent [19]

Houdion

[11] 4,173,250

[45] Nov. 6, 1979

[54] BALANCING AND HOLDING DEVICE FOR A MOLTEN METAL SUPPLY TUNDISH IN A CONTINUOUS CASTING MACHINE

[76] Inventor: Pierre Houdion, 40 rue Waldeck Rousseau, 77360 Vaires, France

[21] Appl. No.: 903,031

[22] Filed: May 4, 1978

[30] Foreign Application Priority Data

May 6, 1977 [FR] France ..... 77 13971

[51] Int. Cl.[2] ..... B22D 11/06; B22D 11/10

[52] U.S. Cl. ..... 164/434; 164/87

[58] Field of Search ..... 164/433, 434, 87

[56] References Cited

U.S. PATENT DOCUMENTS 3,431,971 3/1969 Gyongyos ..... 164/434

*Primary Examiner*—Robert D. Baldwin

*Attorney, Agent, or Firm*—Haseltine, Lake & Waters

[57] ABSTRACT

A continuous casting machine in which a groove in the periphery of a wheel closed by a strip forms the mould and a tundish feeds the mould through a spout extending from a first region of the tundish supply vessel proper, the spout making sealing engagement with the wheel, the tundish being supported for movement about a horizontal axis to one side of which the first region lies and to the other side of which lies a second region of the vessel to which a counterweight is applied, and in which region means for applying a vertical force to the tundish are located.

3 Claims, 2 Drawing Figures

Figure 1:
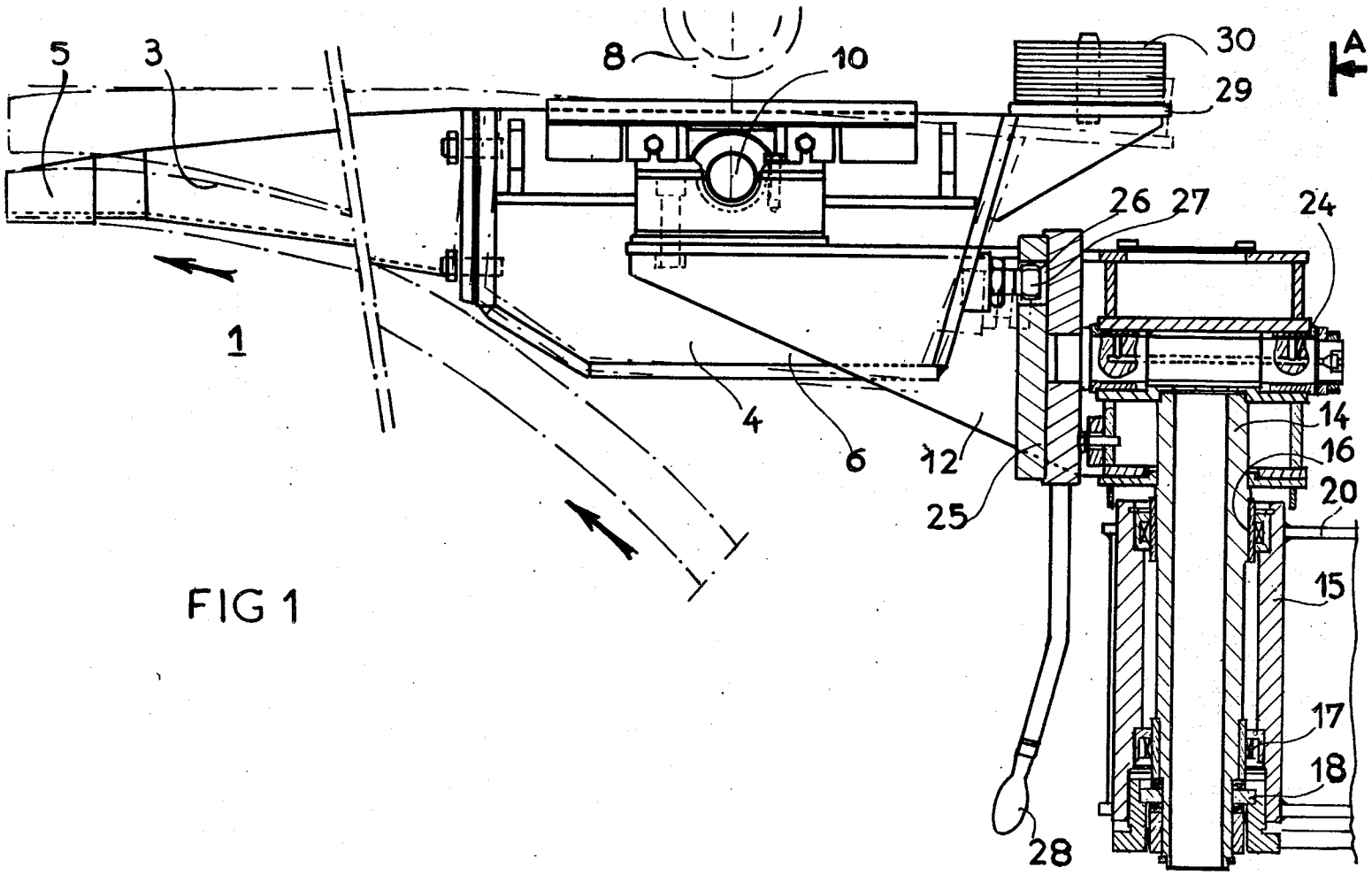

BALANCING AND HOLDING DEVICE FOR A MOLTEN METAL SUPPLY TUNDISH IN A CONTINUOUS CASTING MACHINE

This invention relates to continuous casting machines and more particularly to a system for balancing and holding in the pouring position a molten metal supply tundish of a horizontally fed continuous casting machine including a vertical wheel rotatable about a horizontal axis, a groove in the periphery of which partially closed by a metal strip forms the casting mould.

Casting installations of this kind are well known and one of the problems arising in the operation of such casting machines is so to supply the wheel (which is partially closed by a strip forming the mould) that the level remains strictly constant in said mould.

A supply system whereby this constant level can be obtained is described in British Pat. No. 1,525,321.

The casting installation described in that patent application comprises, more particularly, a molten metal supply tundish for the casting wheel, such supply tundish comprising an actual supply vessel and a casting spout which is open at the top and which is horizontal in its casting position. With a tundish of this kind, an identical level can be obtained in the casting wheel, the spout and the supply tundish. The end of the spout rests on the top part of the casting wheel and friction occurs between the wheel grove and the end of the spout when the wheel rotates during casting.

To maintain sealed contact between the end of the spout and the casting wheel groove and to facilitate sliding during rotation of the wheel, that end of the spout which rests on the casting wheel is provided with a gasket formed from agglomerated fibres of refractory material. This refractory fibre gasket is subject to a pressure which causes its compression, which may be considerable, particularly in the case of molten copper, as in the British Pat. No. 1,525,321 or in the case of the casting of large-section aluminium, this being related to movement predominantly due to the spout length.

When the refractory fibre gasket experiences excessive pressure, the friction is considerable and the gasket, rubbing on the casting wheel, wears out too rapidly.

The tundish is free to move, by rotation about a horizontal axis, which is the common pivot axis of two trunnions on which the tundish rests, and about a vertical axis. This allows any deformation of the casting wheel or irregularity of the groove surface to be taken up. Oscillatory movements of the tundish about these two pivot axes during casting may locally and instantaneously result in additional pressure on the gasket, and such pressure may become disastrous when the gasket is already highly compressed by the weight of the tundish and the molten metal.

Finally, it is difficult to ensure that the gasket is correctly in contact, as is required for sealing purposes, at the start of casting when the tundish is empty.

According to the present invention there is provided a continuous casting machine comprising a vertical wheel rotatable about a horizontal axis and having a peripheral groove partially closed by a strip to form the casting mould, a molten metal tundish having a supply vessel which receives the molten metal and which is borne by two horizontal trunnions resting on a support allowing the tundish to be pivoted about the axis of the trunnions and about a vertical axis, and a spout which is open at the top, in its casting position is horizontal, forms a continuation of the supply vessel and the end of which remote from the supply vessel has a sealing member and is in contact with the surface of the groove of the casting wheel at the top part thereof, a counterweight being fixed to that region of the supply vessel remote from the region of said vessel connected to the spout, said two regions being situated on either side of the axis of the tundish trunnions, and means being provided for applying an upwardly directed vertical force to the region of the vessel where the counterweight is situated.

Figure 2:
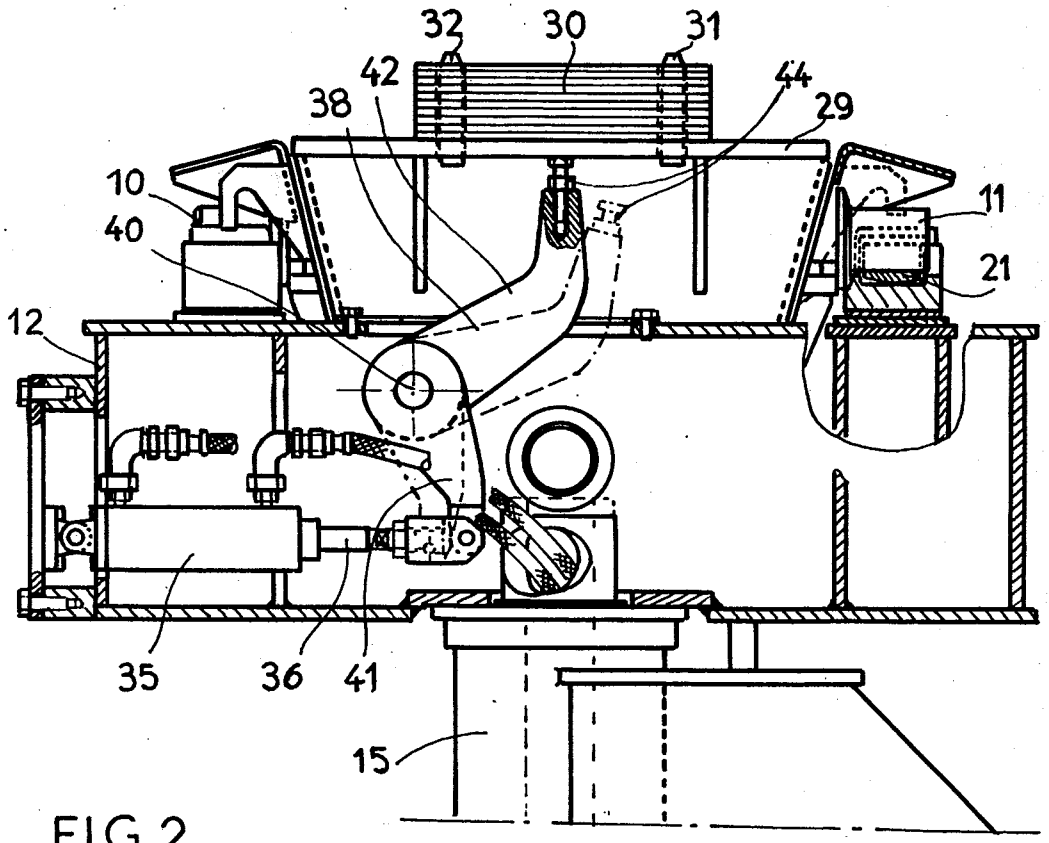

In order that the invention may be well understood there will now be described an embodiment thereof, given by way of example only, reference being had to the accompanying drawings in which:

FIG. 1 is an elevation and partial section of a tundish in position on a casting wheel and provided with a system for balancing and holding it in position; and FIG. 2 is a view in the direction of the arrow A in FIG. 1.

The top part of FIG. 1 shows the periphery of a casting wheel 1, the direction of rotation of which is indicated by an arrow.

At the top point of the casting wheel, the end of a spout 3 of a tundish 4 rests inside a groove 2 of the casting wheel 1. The end of the spout 3 has a gasket 5 made from fibres of refractory material to provide a seal between the spout and the casting wheel during rotation of the latter, in order to obviate any molten metal leakage between the groove and the spout.

This embodiment of the invention is applied to the casting of copper in bar or rod form for the production of machine wire. Copper is fed to a supply vessel 6 for the tundish 4 via a horizontal spout 8 of a rotary furnace disposed above the tundish. This furnace is termed a wheel furnace and is described in British Pat. No. 1,525,321.

In the casting position, the tundish is horizontal and the copper supplied by the spout 8 of the wheel furnace assumes a constantly identical level in the supply vessel, the spout 3 (which is open at the top) and in the mould formed by the groove 2 and a closure strip (not shown), the said vessel, spout and mould forming a single vessel for the molten copper, the free surface of which extends over a wide area.

Referring to FIGS. 1 and 2, the tundish 4 rests via trunnions 10 and 11—which are fixed to a central part of the supply vessel 6—on a support 12 which is in turn fixed on a vertical spindle 14 mounted for rotation inside a column 15 through the agency of needle bearings 16 and 17 and a roller bearing 18.

The column 15 is in turn rigidly connected to a frame 20 of the casting installation.

The tundish supply vessel 6 is extended at one region by the spout 3, which is fixed to the vessel by means of nuts and bolts to secure a sealing member interposed between the spout and the supply vessel. The tundish support trunnions 10 and 11 rest on the support 12 through the agency of bearings, e.g. 21, enabling the tundish to pivot about the axis of the trunnions and to be placed on the support simply by placing the trunnions on the bearings.

Support 12 also supports a horizontal spindle 24 mounted in the support 12 and connected to an actuator disc 25 formed with a groove 26 which forms a cam, inside which a spherical-surface finger 27 engages, said finger being connected to the region of the supply vessel 6 remote from the spout 3. The actuator disc 25 is connected to a handle 28 which allows rotation of said disc connected to spindle 24, with respect to frame 12.

The shape of the groove 26 is such that rotation of the disc 25 produced by handle 28, which is actuated manually, enables the tundish to be pivoted about the axis of the trunnions 10 and 11 to disengage the end of the spout 3 from the casting wheel groove and the finger to be disengaged from the cam groove when the tundish is to be dismantled, e.g. for maintenance, the handle 28 being movable between a position as shown in FIG. 1, in which the tundish is in the casting position, a position in which the spout 3 is in the raised position above the groove 2 (shown in chain-dotted lines in FIG. 1), and a disengagement position in which the finger 27 can disengage from the groove 26, simply by the tundish being raised. This system enables the spout to be placed in the wheel groove carefully so that the gasket is not damaged.

The region of the tundish 4 remote from the spout carries a counterweight 30 by means of a support 29, on which are fixed pins 31 and 32 enabling a stable stack of identical weights to be disposed, such weights having apertures in which the pins 31 and 32 fit to form the adjustable counterweight 30.

The mass of the counterweight 30 is so adjusted that the residual force on the end 5 of the spout 3 when the tundish is filled with copper up to the casting level is kept at a suitable value.

Referring to FIG. 2, a jack 35 is fixed on the support 12, the rod of said jack 35 being connected pivotally to the end of a two-part lever 38. The latter is mounted to pivot about a horizontal pivot in the frame 12 (pivot 40). The two parts 41 and 42 of lever 38 are rigidly connected to pivot 40. The top arm 42 of lever 38 also bears an adjustable stop 44 which, in the jack position shown in FIG. 2 (rod extended), is in contact with the bottom surface of the support 29 of the counterweight 30 connected to the supply vessel 36.

Stop 42 is so adjusted that a specific force can be exerted on the end 5 of spout 3 by means of jack 35, by a vertical thrust extending upwardly and applied to the bottom surface of support 29 connected to the back of the tundish.

Actuation of the jack 35 at the start of casting, when the tundish is empty, therefore results in a force being exerted on the end of the spout 3 bearing the refractory fibre gasket, in order to counterbalance the counterweights 30 and ensure the seal between the spout and the casting wheel when molten copper starts to be fed to the mould.

It will therefore be apparent that the main advantages of the embodiment described are that a moderate and adjustable force can be exerted on the end of the spout during casting while a likewise adjustable force can be exerted on the end of said spout at the start of every casting operation when the tundish is empty and unbalanced, when it starts to be filled and the copper is poured.

A system different from the jack and lever system described above could be used for applying an upward vertical force to the region of the tundish remote from the spout when the tundish is empty. For example, a cam system is feasible, which comes into contact with the tundish and which is associated with a mechanical spring to ensure elasticity of the pressure application system. A spring system could, for example, be associated with the above-described cam 25–26 or with the finger 27 co-operating with said cam, and the cam may have a position allowing a vertical force to be applied to the tundish through the agency of the finger 27, the spout being in the operative position.

What is claimed is:

1. A continuous casting machine comprising a vertical wheel rotatable about a horizontal axis and having a peripheral groove partially closed by a strip to form the casting mould, a molten metal tundish having a supply vessel which receives the molten metal and which is borne by two horizontal trunnions resting on a support allowing the tundish to be pivoted about the axis of the trunnions and about a vertical axis, and a spout which is open at the top, in its casting position is horizontal, forms a continuation of the supply vessel and the end of which remote from the supply vessel has a sealing member and is in contact with the surface of the groove of the casting wheel at the top part thereof, a counterweight being fixed to that region of the supply vessel remote from the region of said vessel connected to the spout, said two regions being situated on either side of the axis of the tundish trunnions, and means being provided for applying an upwardly directed vertical force to the region of the vessel where the counterweight is situated.

2. A machine according to claim 1, characterised in that the means for applying an upwardly directed vertical force to that region of the vessel where the counterweight is situated includes a lever, the central part of which is connected to a horizontal pivot fixed relative to the trunnion support, one end of which is pivotally connected to the rod of a jack fixed relative to the trunnion support and the other end of which engages, via an adjustable stop, a support bearing the counterweight connected to the supply vessel for the application of the vertical force.

3. A machine according to claim 1 characterised in that the trunnion support of the tundish is mounted rotatably about a vertical axis and bears a horizontal spindle mounted on the support and connected to an actuator, a cam track and a follower one of which is on the trunnion and the other is on the actuator and operable to move the tundish between its operating position in which the spout is in contact with the casting wheel groove and at least one inoperative position in which the spout is raised above the casting wheel groove.

* * * * *